United States Patent [19]

Willis

[11] Patent Number: 4,608,789

[45] Date of Patent: Sep. 2, 1986

[54] STAR DOME STRUCTURE

[76] Inventor: Lyle E. Willis, 212 Sheridan Ave., DeLand, Fla. 32720

[21] Appl. No.: 530,710

[22] Filed: Sep. 9, 1983

[51] Int. Cl.[4] ..... E04B 1/32

[52] U.S. Cl. ..... 52/81; 52/DIG. 10

[58] Field of Search ..... 52/80, 81, 82, DIG. 10

[56] References Cited

U.S. PATENT DOCUMENTS

| | | | |
|---|---|---|---|
| 2,682,235 | 6/1954 | Fuller | 52/81 |
| 3,137,371 | 6/1964 | Nye | 52/81 |
| 3,925,940 | 12/1975 | O'Connell, Jr. et al. | 52/81 |
| 3,990,195 | 11/1976 | Gunther | 52/81 |
| 4,258,513 | 3/1981 | Bergman | 52/81 |
| 4,263,758 | 4/1981 | Seaich | 52/81 |
| 4,364,207 | 12/1982 | Bergman | 52/81 |

FOREIGN PATENT DOCUMENTS

| | | | |
|---|---|---|---|
| 149794 | 5/1937 | Fed. Rep. of Germany | 52/81 |

*Primary Examiner*—Carl D. Friedman
*Assistant Examiner*—Michael Safavi
*Attorney, Agent, or Firm*—Duckworth, Allen, Dyer

[57] ABSTRACT

A star dome structure having a rib vault formed from prefabricated panels. The structure includes a base, a four-sided star dome, four pentatives, and four column panels. One of four heptagonal panels formed from prefabricated triangular panels is disposed in each space formed by the dome, pentatives, and columns, the lower edge of each heptagonal panel resting on the base. The space between the column panels and the base permit entry and window walls to be installed with the lower edges of the column panels providing eaves.

8 Claims, 11 Drawing Figures

STAR DOME STRUCTURE

BACKGROUND OF THE INVENTION

1. Field of the Invention

The present invention relates to geodesic dome structures and more particularly to a structure having a star dome, star vault, and heptagonal panels.

2. Description of the Prior Art

The development of the geodesic dome structure by R. B. Fuller and described in U.S. Pat. No. 2,682,235 has resulted in a number of designs of this type. The geodesic-type structure has a high strength-to-weight ratio and is highly stable in face of storms. The dome-type building provides a shell having the capability of very flexible use of the space. The majority of geodesic dome structures are formed from triangular panels joined together to produce various geometrical forms. For example, in U.S. Pat. No. 3,925,940 to O'Connell et al, triangular panels are joined to form hexagonal units grouped to form a hexagonal dome portion. In U.S. Pat. No. 4,263,758 to Seaich, a similar structure is shown having hexagonal panels arranged to form an octagonal roof dome. Other six-sided panel constructions are shown in U.S. Pat. No. 3,990,195 to Gunther. A structure based on a five-sided panel is described in two patents to Bergman, U.S. Pat. Nos. 4,258,513 and 4,364,207. The majority of the known geodesic dome structures require the addition of eaves or "eye brows" to protect window and door openings. The present invention is based on a combination of 3, 4, and 7-sided panels and provides an eave structure without the necessity of add-ons.

SUMMARY OF THE INVENTION

My invention is a star dome, vaulted rib, star vault structure and is an evolution from the barrel or tunnel vault. As is well known, the tunnel vault is a continuous arch, generally semi-circular. When two tunnel vaults are joined at right angles, the resultant structure is termed a groin vault due to the shapes defined by the surface intersections. By combining a domical vault (a dome formed from sections of a hemisphere separated by groins) with the groin vault, a rib vault is obtained. The main loads in the rib vault are carried by a structure of ribs. The spaces between the ribs are filled with panels. When the ribs of a rib vault form a star shape, it is termed a star vault. My novel structure may be considered to be an evolution of the ribbed star vault into a star dome.

Advantageously, an elementary version of the structure of the invention comprises a four pointed star dome portion having the points thereof extending downward to form four pendetives. The dome is supported by four triangular columns and four trapezoidal base panels. The lengths of the edges of the pendetives, columns, and the base panels are preferably equal with the distance between adjacent base panel bases being equal to the edge lengths. As may be understood, these edges with the base spacing form a set of four seven-sided polygons or heptagons.

The bases of the base panels form elements of a square base. Thus, the heptagonal spaces may be framed in to fit on a square slab, or in another form to be based on an octagonal slab. However, by modifying the triangular shape of the pendetives to be inverted trapezoids and the triangular columns to be right trapezoids, the size of the heptagonal opening will be reduced, increasing the "squareness" of the base panel base edges. In the preferred version of my structure, the above-mentioned heptagonal openings are closed by a set of heptagonal panels. The trapezoidal base panels are omitted such that the structure is supported by the heptagonal panels.

The novel construction of my star dome-type structure provides a number of advantages not available in known prior art dome-type structures. Known geodesic domes require circular or truncated circular bases which represent poor efficiency in construction. The present invention provides a basically square base, permitting a low cost square slab to be used. Since no load bearing walls or inside supports are required except at heptagon base, the designer has complete freedom in the use of the interior space. The strength of my structure is greater than that of a conventional geodesic dome. As will be described in more detail hereinafter, the omission of the trapezoidal base panels advantageously provide an eave space for vertical entrance panels for doors and windows. The overhang of the column panels provide eaves, eliminating the necessity for constructing add-on "eye brows" as required by prior art domes. Thus, buildings formed from my dome structure have a simple but attractive roof line which creates overhanging eaves to protect doors and windows from sun and rain.

It is therefore a principal object of my invention to provide a star dome, vaulted rib, star vault structure suitable for homes, small offices, factories, and the like.

It is another object of my invention to provide a dome structure having a four-pointed star-shaped dome with four pendetives, four columns, and four base panels defining four heptagon spaces.

It is still another object of my invention to provide a dome structure than can be constructed on an essentially square base or slab.

It is still a further object of my invention to provide a dome structure supported by a set of heptagonal panels having a vertical entry access panel between each pair of such panels.

It is yet another object of my invention to provide a dome structure having a roof line forming eaves extending from the column panels over the vertical access panels and that require no dormer or eyebrow structures.

It is a further object of my invention to provide a self-supporting dome structure having superior strength, attractive appearance, and low cost.

These and other objects and advantages of my invention will become apparent from the following detailed description and the drawings.

DETAILED DESCRIPTION OF THE PREFERRED EMBODIMENT

Figure 1:
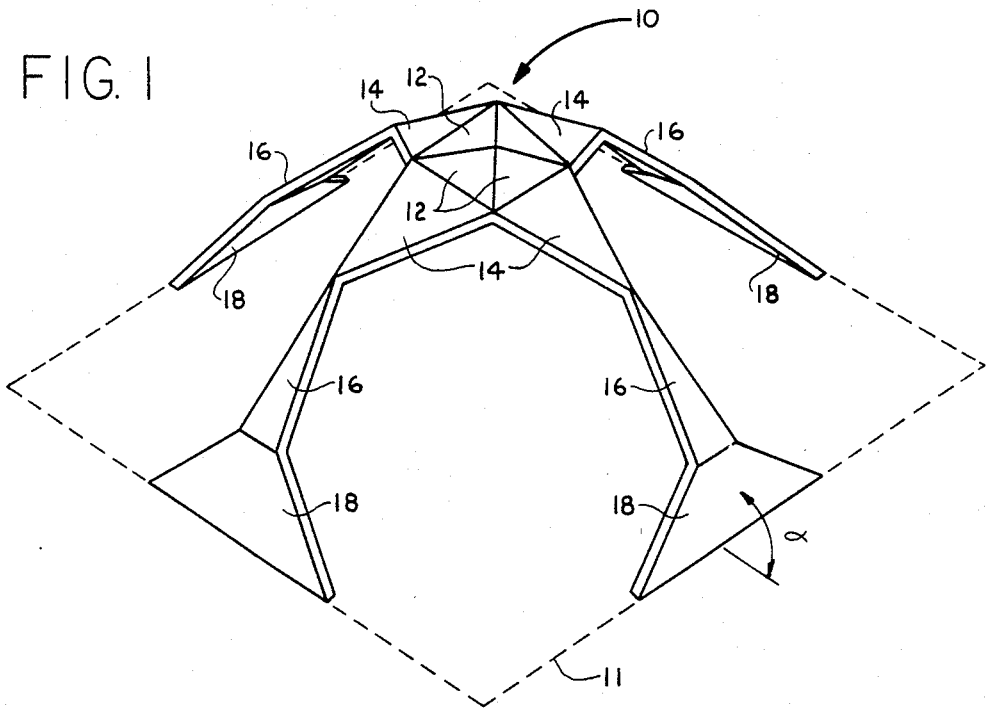
FIG. 1 is a simplified perspective drawing of a star vault having a star dome from which the invention has evolved.

Before describing the preferred embodiment of my star dome, vaulted rib, star vault structure, the evolution from the classical star vault will be described. Turning to FIG. 1, a simplified drawing is shown of a star vault with a star dome. At the top of the structure is a four-faced hip roof-type dome 10 having four triangular elements 12 in the form of a square. Adjacent each square is a pendetives 14 formed from a triangular panel. Each pendetives is supported by a triangular column 16 which rests on a trapezoidal base panel 18. Base panel 18 slopes outward from the base at an acute angle $\alpha$ as shown. It will be noted that the bases of the base panels 18 form elements of a square as indicated by the dashed lines 11. The groins formed by the sides of the pendetives 14, the columns 16, the base panels 18, and the spaces between base panels 18 may be seen to form a polygon. In accordance with my invention, I prefer that the lengths of the sides of the polygon be equal.

Figure 2:
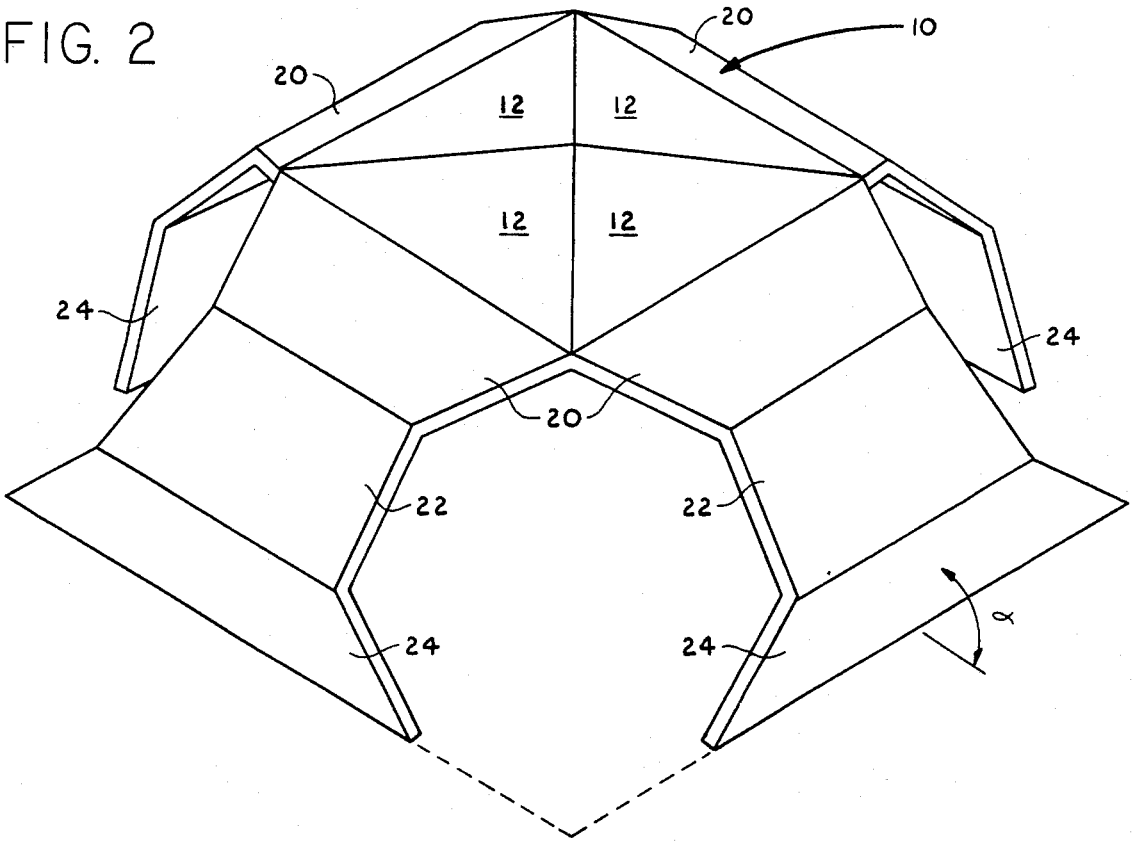
FIG. 2 is a similar structure of FIG. 1 with the pendetives and columns broadened for greater stability.

In FIG. 2, the basic structure of FIG. 1 has been modified by widening the pendetives, the columns, and the base panels to produce a larger dome 10 and smaller polygonical groins. Thus, pendetives 20 are in the form of inverted trapezoids and columns 22 are trapezoids, as are base panels 24. The angles of the trapezoids are selected to produce equal sided polygon sides for the groins. It may be noted that dome 10 formed from four triangular panels 12 is in conventional hip roof form as used in conventional roof construction. Next, it may be seen that the intersections of the various panels define ribs which make up a star vault with a four-pointed star dome.

The widening of the panels of the structure of FIG. 2 greatly increases the stability of the structure over that shown in FIG. 1 and provides a greater covered base area.

Figure 3:
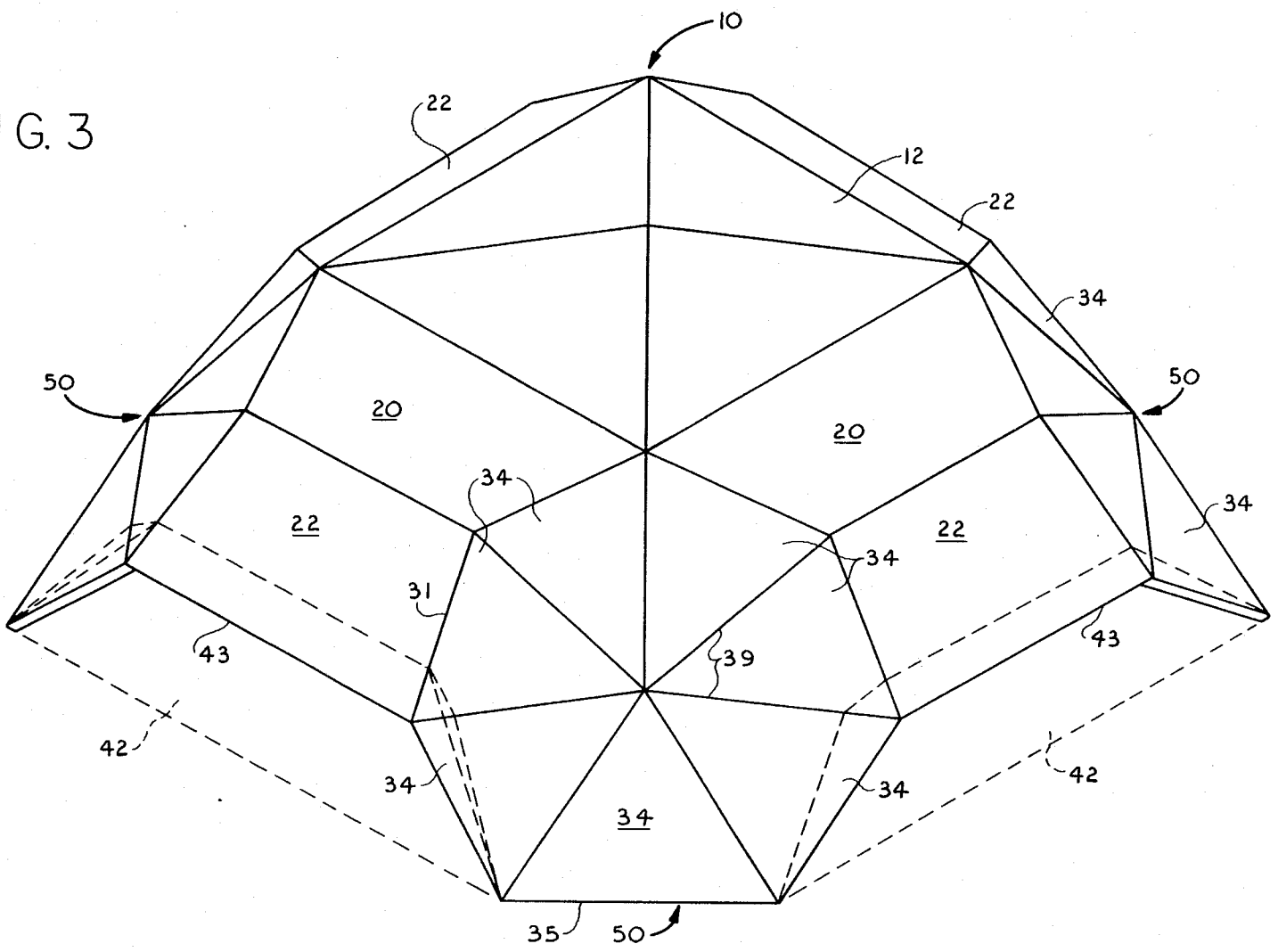
FIG. 3 is a schematic drawing of a practical structure in accordance with my invention evolved from the structure of FIG. 2 with the addition of heptagonal panels.

The final step in the evolution of my star dome structure is exemplified by the schematic drawing of a star dome structure in accordance with the invention of FIG. 3. This structure is similar to that of FIG. 2 but which has the heptagonal openings closed by heptagonal panels 50 composed of seven isosceles triangular panels 34. The base panels 24 shown in FIG. 2 have been eliminated, and the structure rests on the base edge 35 of the lower triangular panel 34 of the heptagon panels 50. The omission of the base panels provides space for a window and door wall for providing access into the structure. As indicated by the dashed lines, vertical window walls 42 may be erected with the upper edges thereof being inset under column panels 22. The lower edges 43 of column panels 22 thus act as eaves over the wall sections 42.

Figure 4:
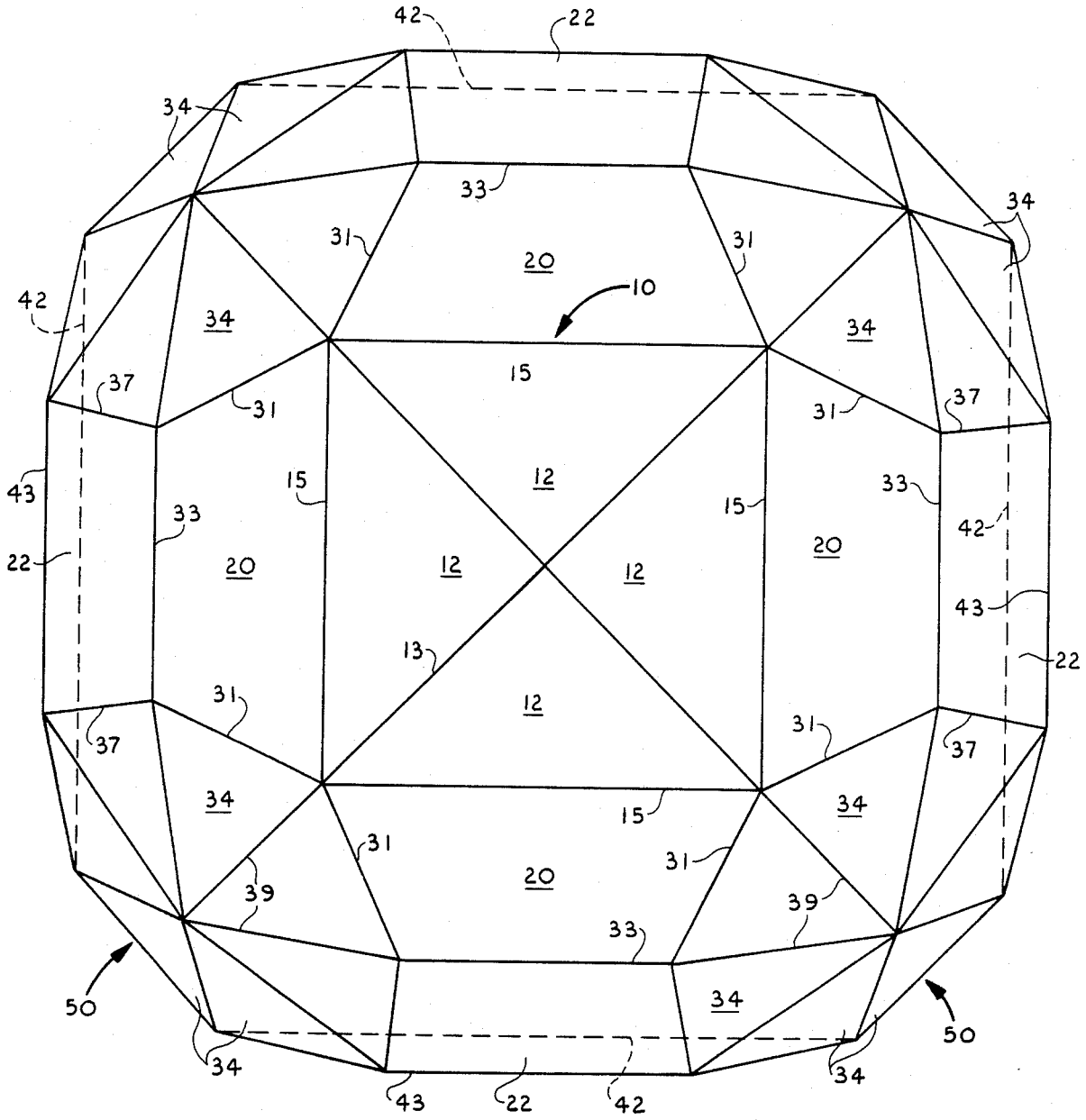
FIG. 4 is a top view of a structure of the type shown in FIG. 3.

Additional details of the dome structure of my invention will be seen in FIG. 4 which represents a top view of the structure of FIG. 3. It may be noted that the structure may be mounted on a relatively square slab with a minimum of unused slab area. The strength of the structure results from the rib arrangement defined by the edges of the various panels. For example, a primary rib is defined by the lower edges 43 of the column panels 22 and the lower edges of the adjacent triangular heptagon panels. An intermediate rib is defined by the lower edges 33 of the pendetive panels and the adjacent edges 39 of triangular panels 34. Also the lower edges 15 of the roof panels 12 form an intermediate rib.

Figure 5:
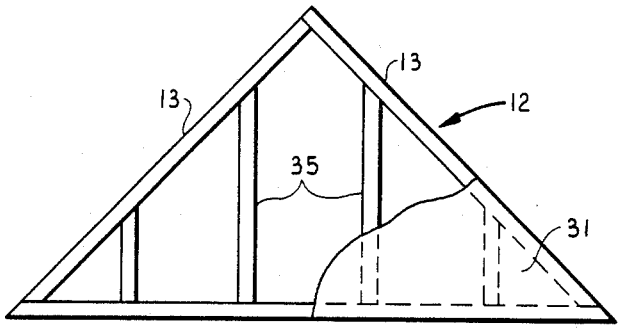
FIG. 5 shows structural details of a practical dome panel for the structure of FIG. 4.
Figure 6:
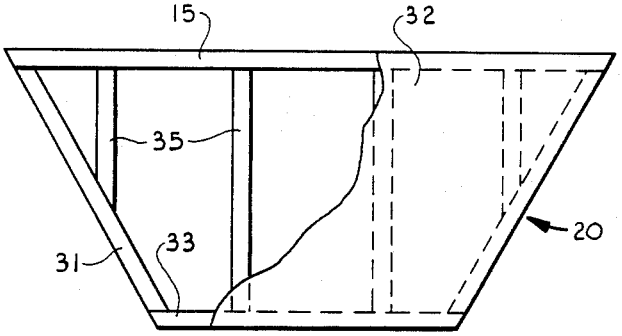
FIG. 6 shows structural details of a practical pendetives panel for the structure of FIG. 4.
Figure 7:
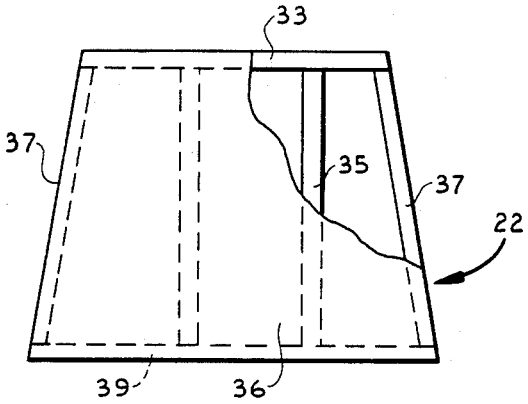
FIG. 7 shows structural details of a practical column panel for the structure of FIG. 4.
Figure 8:
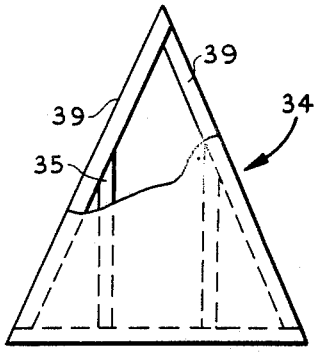
FIG. 8 shows structural details of a practical star dome panel for the structure of FIG. 4.

Turning now to FIGS. 5, 6, 7, and 8 and with reference to FIG. 4, the practical construction of the various panels of FIG. 4 will be shown. FIG. 5 shows the construction of a typical triangular roof dome panel 12. A framework is constructed from suitable size lumber. The size lumber will depend upon the size of the structure and the load requirements. Typically, framing members may be conventional $2\times8$ inch stock. In the roof panel, a base member 15 is provided which connects with matching top member 15 of panel 20 in FIG. 6. Two members 13 form the equal sides of the triangular panel 12 and have studs 35 between member 15 and member 13. The panel may be covered with a skin 31 formed from $\frac{1}{2}$ inch plywood or the like. The panels shown in FIGS. 6, 7, and 8 are constructed in a similar fashion. It is to be noted that the adjacent framing members such as members 15 in FIG. 5 and FIG. 6 are set at the appropriate angles so that the members mate properly when the panels are assembled. Framing member 33 of FIG. 6 mates with framing member 33 of FIG. 7 and will be set at the proper angles so that these members mate properly.

The panels may be prefabricated and later assembled at the building site. Preferably, the framing members of adjacent panels are bolted together for maximum strength and rigidity of the structure.

Figure 9:
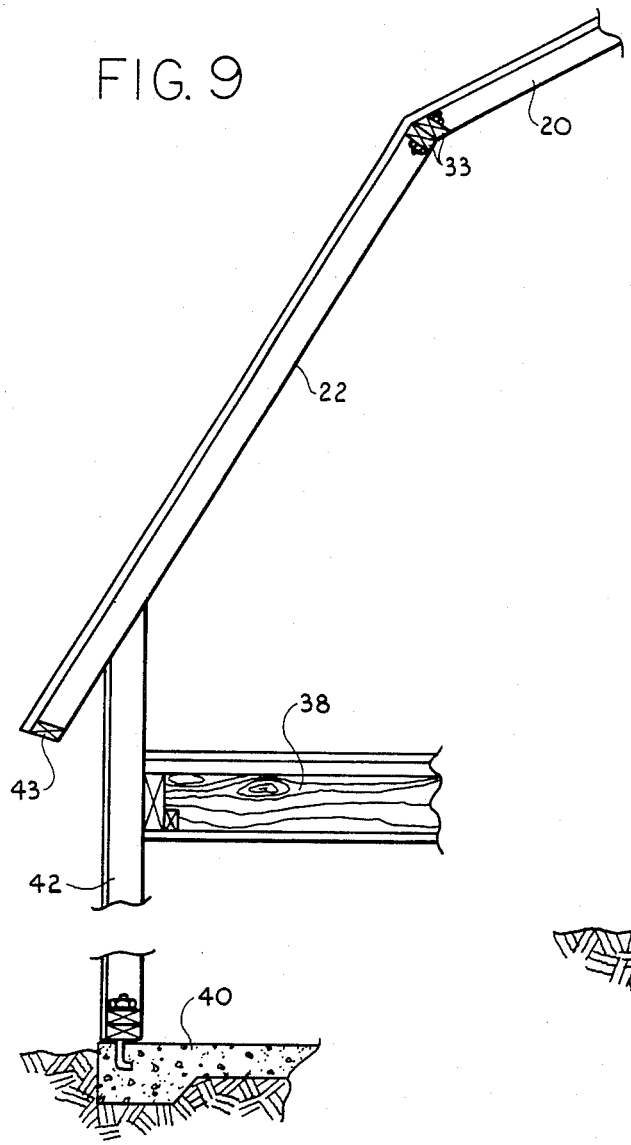
FIG. 9 shows a cross section through a column panel, second floor, and entry wall showing an eave effect.
Figure 10:
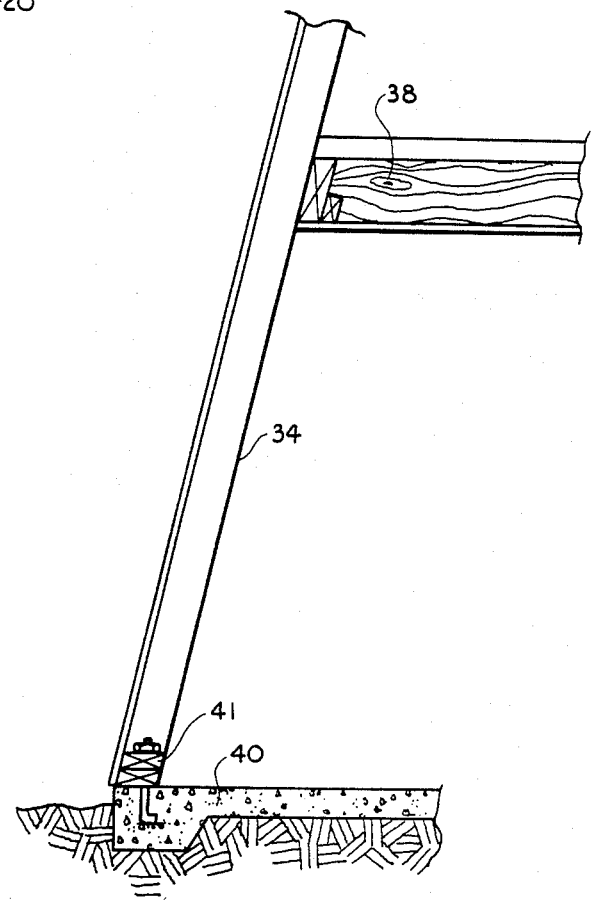
FIG. 10 is a cross sectional view of a septagonal panel bolted to a slab.

In FIG. 9, a cross sectional view of a column panel 22 is shown with an entry wall 42 resting on slab 40. As will be noted, the lower edge 43 of panel 22 provides an eave for protection of entry wall 42. A second floor 38 is shown which may be supported by entry wall 42. In FIG. 10, a cross section through the base triangular panel 34 of a heptagon panel 50 is shown in which the second floor is seen to be supported by panel 34. The manner in which framing elements 33 of panel 20 and panel 22 are set at the appropriate angles, so that the members properly mate, may be seen in FIG. 9. Similarly, the angular installation of plates 41 in panel 34 which are bolted to slab 40 may be noted in FIG. 10.

It is to be understood that the construction details shown in FIGS. 5 through 10 are for exemplary purposes only, and a greater number of studs and bracings of the various panels may be provided for larger structures.

Figure 11:
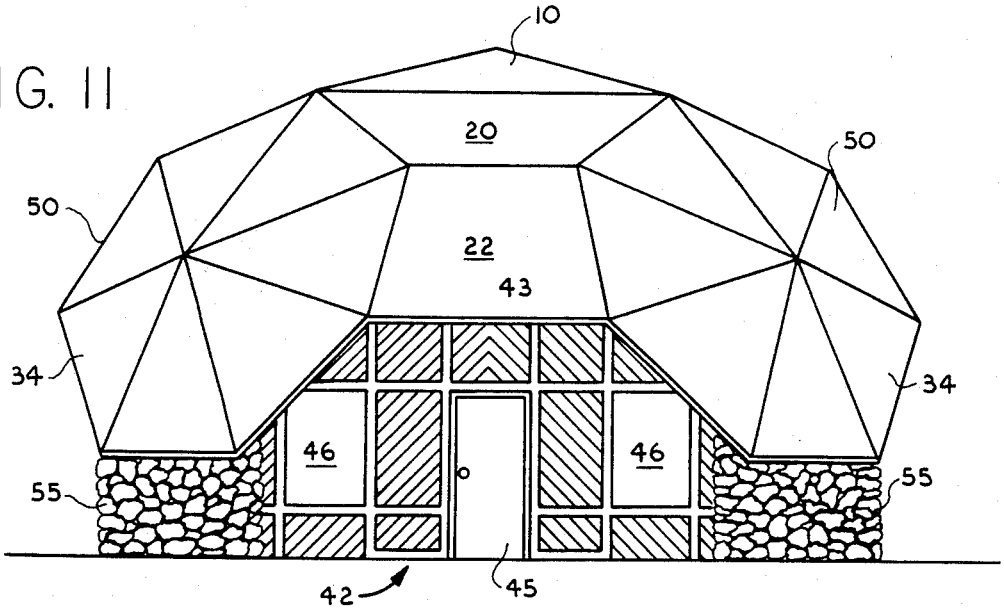
FIG. 11 is a front elevation of a typical residence design using my star dome structure.

Having described the basic construction of the preferred embodiment of my invention, a simple residential structure design utilizing my invention is shown in FIG. 11. In this version of the invention, the star dome structure comprising dome 10, pendetives 20, column panels 22, and heptagon panels 50 is supported by stone foundation walls 55. Foundation walls 55 may be set on the corners of a square slab. Entry wall 42 is shown having an entrance door 45 and a pair of windows 46. As previously shown, entry wall 42 is vertical and the top edge is inset from the eave edge 43 of panel 22. Although not shown, corresponding wall sections 42 may be erected in the other three spaces between heptagonal panels 50. Such walls may contain windows or doors as desired. The outside surfaces of the panels of the dome structure may be covered with roofing material.

Although not shown in FIG. 10, skylights and windows may be installed through the appropriate panels when the second floor is used for living space. It is also common in a structure of this type to place ventilating openings at the peak of dome 10 to form a chimney-like effect for purposes of air circulation for both heating and cooling.

Although a specific design has been shown in FIG. 11, it will be obvious to those of skill in the art that a very wide number of changes and modifications may be made to my basic design without departing from the spirit or scope of my invention. It is possible to cluster two or more of my star dome structures to economically provide a very large amount of floor space. For variety, structures may be built of various heights and interconnected. My design also lends itself to mass production of prefabricated buildings in which the components can be economically produced at a factory and quickly assembled on site to obtain a dried-in structure.

I claim:

1. A dome structure comprising:

a base;

a four-sided star dome;

a set of four pendetives for supporting said star dome;

a set of four column panels supporting said set of pentatives;

a set of four heptagonal panels, each of said panels having a lower edge thereof resting on said base, upper edges of each of said heptagonal panels attached to the edges of adjacent ones of said pendetives and adjacent ones of said column panels.

2. A dome structure as defined in claim 1 which further comprises:

a set of four entrance panels disposed vertically on said base, one panel of said set disposed between adjacent pairs of said heptagonal panels.

3. A dome structure as defined in claim 1 in which said star dome is a hip roof.

4. A dome structure as defined in claim 1 in which said pendetives are inverted trapezoids.

5. A dome structure as defined in claim 1 in which said column panels are trapezoids.

6. A dome structure as defined in claim 1 in which said heptagonal panels comprise a set of seven isosceles triangular panels.

7. A dome structure as defined in claim 1 in which said base is essentially square.

8. A dome structure as defined in claim 2 in which the lower edges of said column panels form protective eaves of said entrance panels.

* * * * *